United States Patent [19]

Miller et al.

[11] Patent Number: 4,538,971

[45] Date of Patent: Sep. 3, 1985

[54] ASSEMBLY OF TANK LID AND FAN MEANS OF A WET/DRY VACUUM

[75] Inventors: Jonathan Miller, Haworth, N.J.; Rudolph W. Wacek, Montoursville, Pa.; Robert C. Berfield, Jersey Shore, Pa.; Ronald F. Meland, Muncy, Pa.; Robert L. Crevling, Jr., Williamsport, Pa.; Lonnie B. Lawson, Jr., Linden, Pa.

[73] Assignee: Shop-Vac Corporation, Williamsport, Pa.

[21] Appl. No.: 514,491

[22] Filed: Jul. 18, 1983

[51] Int. Cl.[3] ..... F04B 17/00; F04B 35/04

[52] U.S. Cl. ..... 417/423 A; 15/327 F; 15/413; 55/DIG. 3

[58] Field of Search ..... 417/423 A, 368, 424; 55/470, DIG. 3; 15/353, 327 D, 327 R, 327 F, 412, 327 A, 413

[56] References Cited

U.S. PATENT DOCUMENTS

| | | | |
|---|---|---|---|
| 2,152,756 | 4/1939 | Billmyre | 15/327 F |
| 2,295,984 | 9/1942 | Wilson | 15/327 F |
| 2,767,904 | 10/1956 | Doyle | 417/423 A |
| 2,778,563 | 1/1957 | Doyle | 417/423 A |
| 2,884,185 | 4/1959 | Dolan | 15/413 |
| 3,130,246 | 4/1964 | Banks | 417/424 |
| 3,263,908 | 8/1966 | Kroker et al. | 55/470 |
| 3,909,219 | 9/1975 | Fromknecht | 55/DIG. 3 |
| 4,080,104 | 3/1978 | Brown, Jr. | 15/353 |
| 4,142,270 | 3/1979 | Nauta | 15/353 |
| 4,330,899 | 5/1982 | Miller et al. | 15/326 |

FOREIGN PATENT DOCUMENTS

| | | | |
|---|---|---|---|
| 2541422 | 3/1977 | Fed. Rep. of Germany | 417/423 A |
| 937312 | 9/1963 | United Kingdom | 15/353 |
| 2036544 | 7/1980 | United Kingdom | 15/353 |

*Primary Examiner*—Carlton R. Croyle
*Assistant Examiner*—Donald E. Stout
*Attorney, Agent, or Firm*—Ostrolenk, Faber, Gerb & Soffen

[57] ABSTRACT

A by-pass type wet/dry vacuum is provided with a removable lid assembly that includes an electric motor having a lower insulating housing, a cover for the upper end of the motor, a blower housing including vanes for regulating flow of main blower air, a fan having a pancake type impeller, a fan cover and a tank lid having an integrally formed float cage. Assembly of these elements is achieved by making all electrical connections between the motor, a power cord extending to the motor cover, and a manually operated control switch mounted on the motor cover; inverting the motor cover, inserting the upper end of the motor downward into the cover where the former is grasped by snap type retainers formed integrally with the cover, inverting the blower housing and securing same to the motor cover with a plurality of screws, securing the impeller to the lower end of the motor shaft, inverting the fan cover and securing it to the blower housing utilizing screws, placing the float ball in a depression of the fan cover, inverting the tank lid and securing same to the blower housing by means of screws. All of the above elements are assembled to one another without the necessity of lifting any of the elements once they are secured to the other elements.

15 Claims, 16 Drawing Figures

FIG. 5
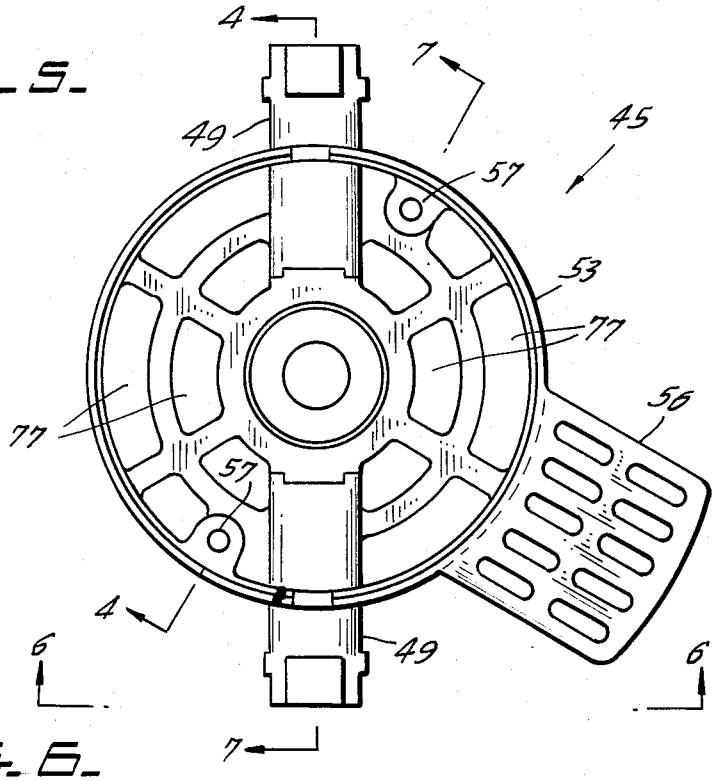
FIG. 6
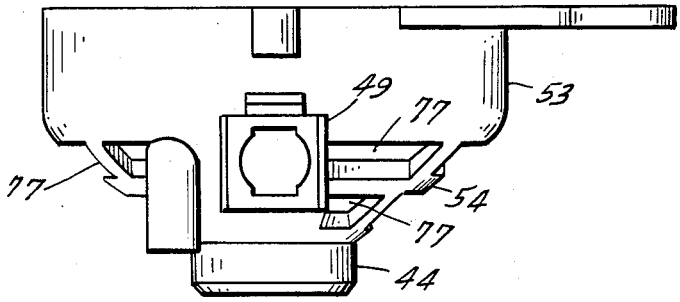
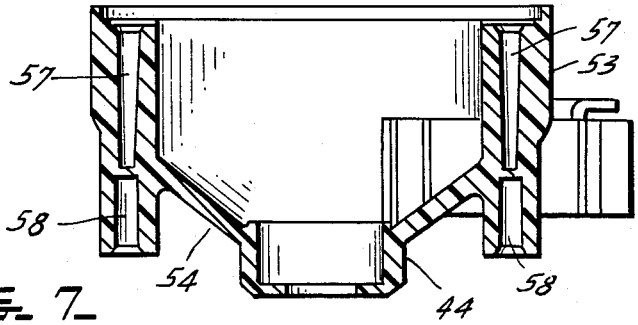
FIG. 7

FIG. 10.
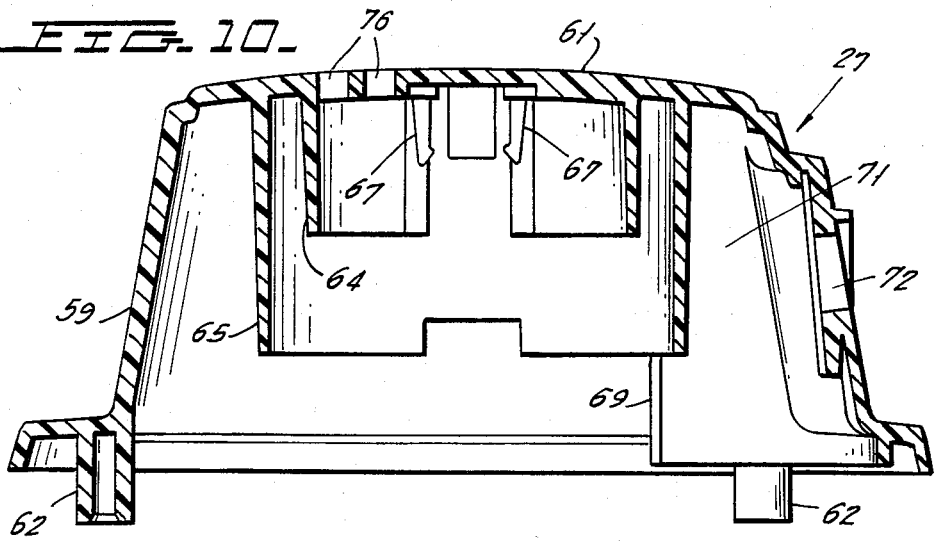
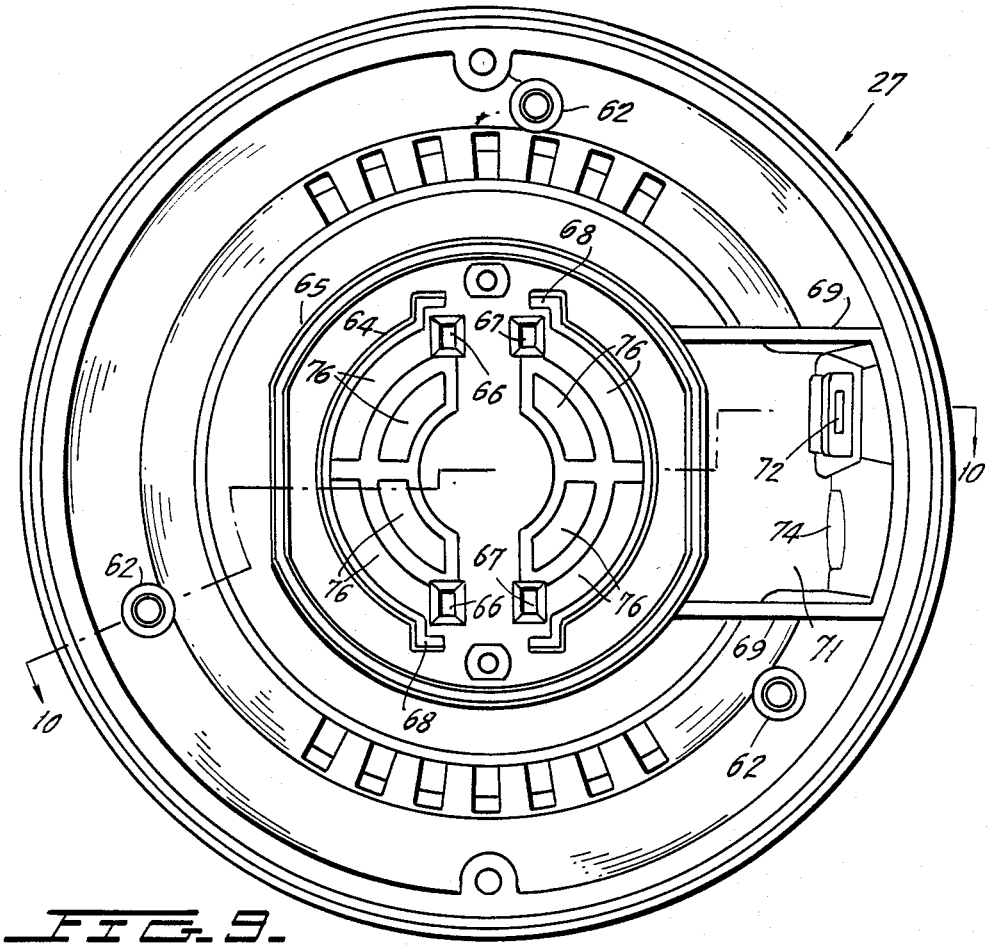
FIG. 9.

ASSEMBLY OF TANK LID AND FAN MEANS OF A WET/DRY VACUUM

BACKGROUND OF THE INVENTION

This invention relates to so-called bypass type electric motor operated vacuum cleaners, and more particularly relates to a construction thereof that facilitates assembly of the removable tank lid and elements mounted thereto.

Many so-called bypass type vacuum cleaners include a tank having a lid forming a removable closure for the top opening of the tank wherein sweepings are collected. This lid also mounts a housing for a fan impeller, an electric motor for rotating the impeller and a molded insulating housing for the motor. As described in U.S. Pat. No. 4,330,899 issued May 25, 1982, to J. Miller et al for "Noise Reducing Blower Motor Housing Means For Vacuum Cleaner, Or The Like", the motor housing is also provided with internal partitions that separate motor cooling air generated by an auxiliary fan from the working air generated by the vacuum producing main fan. In addition, housing partitions are provided to define plenums wherein the velocity of working airflow is reduced before the working air is discharged from the motor housing.

Typically, in prior art constructions of this type assembly of the lid with the elements mounted thereto is a tedious job which requires subassemblies to be repositioned many times before the assembly is completed. As will hereinafter be seen, the construction according to the teachings of the instant invention is such that after two elements are secured to one another, they need not be repositioned in order to attach another element thereto. This is accomplished by providing a construction in which the main elements to be assembled consist of an electric motor having a lower insulating housing, a cover for the upper end of the motor, a blower housing including vanes for regulating flow of main blower air, a fan having a pancake type impeller, a fan cover and a tank lid having an integrally formed float cage.

BRIEF DESCRIPTION OF THE INVENTION

Assembly of these elements is achieved by making all electrical connections between the motor, a power cord extending into the motor cover, and a manually operated control switch mounted on the motor cover, inverting the motor cover, inserting the upper end of the motor downward into the cover where the former is grasped by snap type retainers formed integrally with the cover, inverting the blower housing and securing same to the motor cover with a plurality of screws, securing the impeller to the lower end of the motor shaft, inverting the fan cover and securing it to the blower housing utilizing screws, placing the float ball in a depression of the fan cover, inverting the tank lid and securing same to the blower housing by means of screws. All of the above elements are assembled to one another without the necessity of lifting any of the elements once they are secured to other elements.

Accordingly, the primary object of the instant invention is to provide a novel construction for a bypass type vacuum cleaner.

Still another object is to provide a vacuum cleaner of this type constructed to facilitate assembly.

Still another object is to provide a vacuum cleaner of this type constructed to eliminate many resilient type seals required of prior art constructions.

A further object is to provide a vacuum cleaner of this type in which the motor cover is provided with partitions for directing the flow of cooling air through and then away from the motor.

A still further object is to provide a vacuum cleaner of this type in which overall costs of production are reduced.

These objects as well as other objects of this invention shall become readily apparent after reading the following description of the accompanying drawings in which:

BRIEF DESCRIPTION OF THE DRAWINGS

FIG. 5 is a top view of the lower housing.

FIG. 6 is a side elevation of the lower housing looking in the direction of arrows 6—6 of FIG. 5.

FIG. 7 is a cross-section taken through line 7—7 of FIG. 5 looking in the direction of arrows 7—7.

FIG. 9 is a bottom view of the motor cover.

FIG. 10 is a cross-section through line 10—10 of FIG. 9 looking in the direction of arrows 10—10.

DETAILED DESCRIPTION OF THE DRAWINGS

Figure 1:
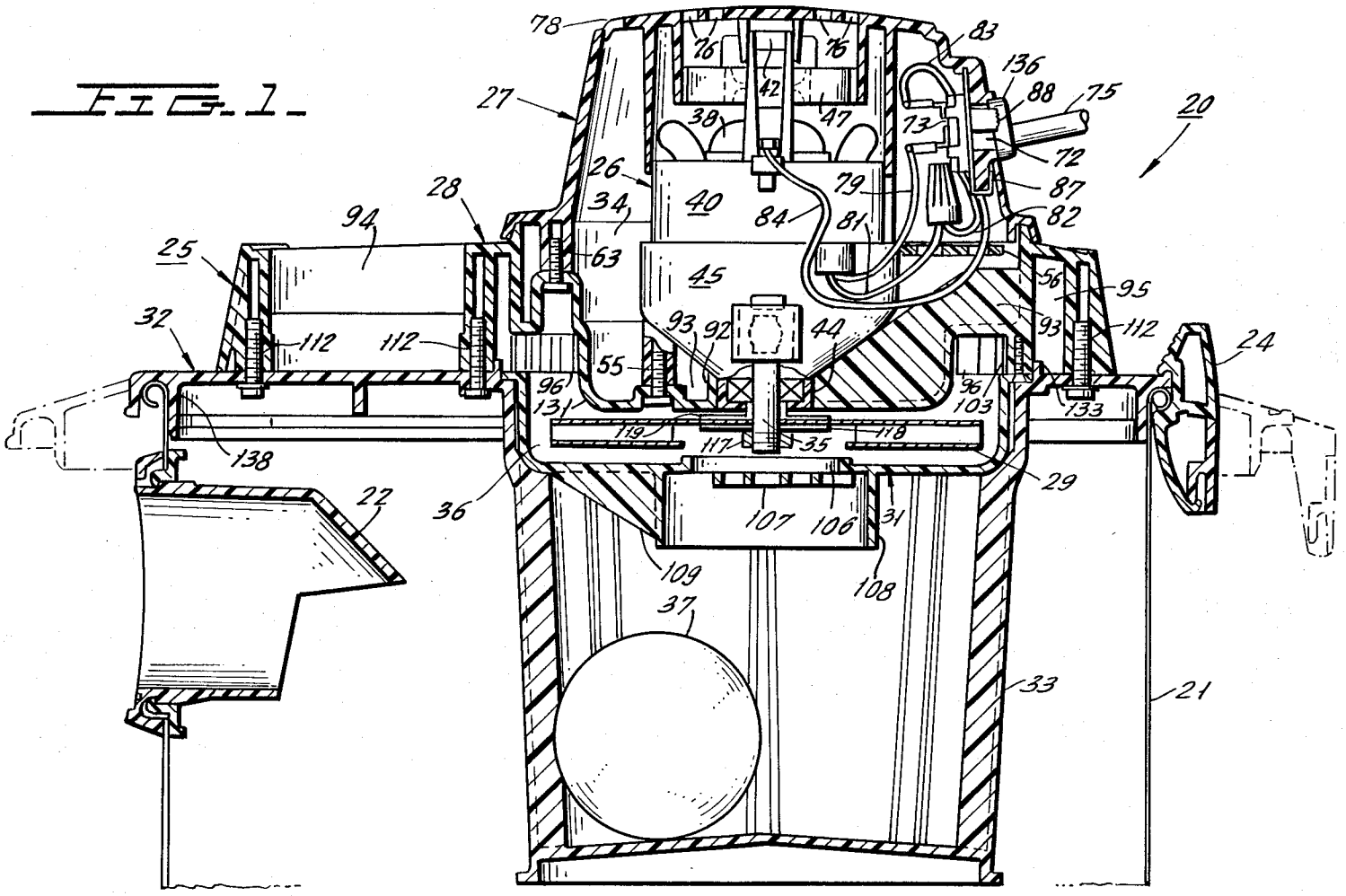
FIG. 1 is a vertical cross-section of a bypass type vacuum cleaner constructed in accordance with teachings of the instant invention.
Figure 2:
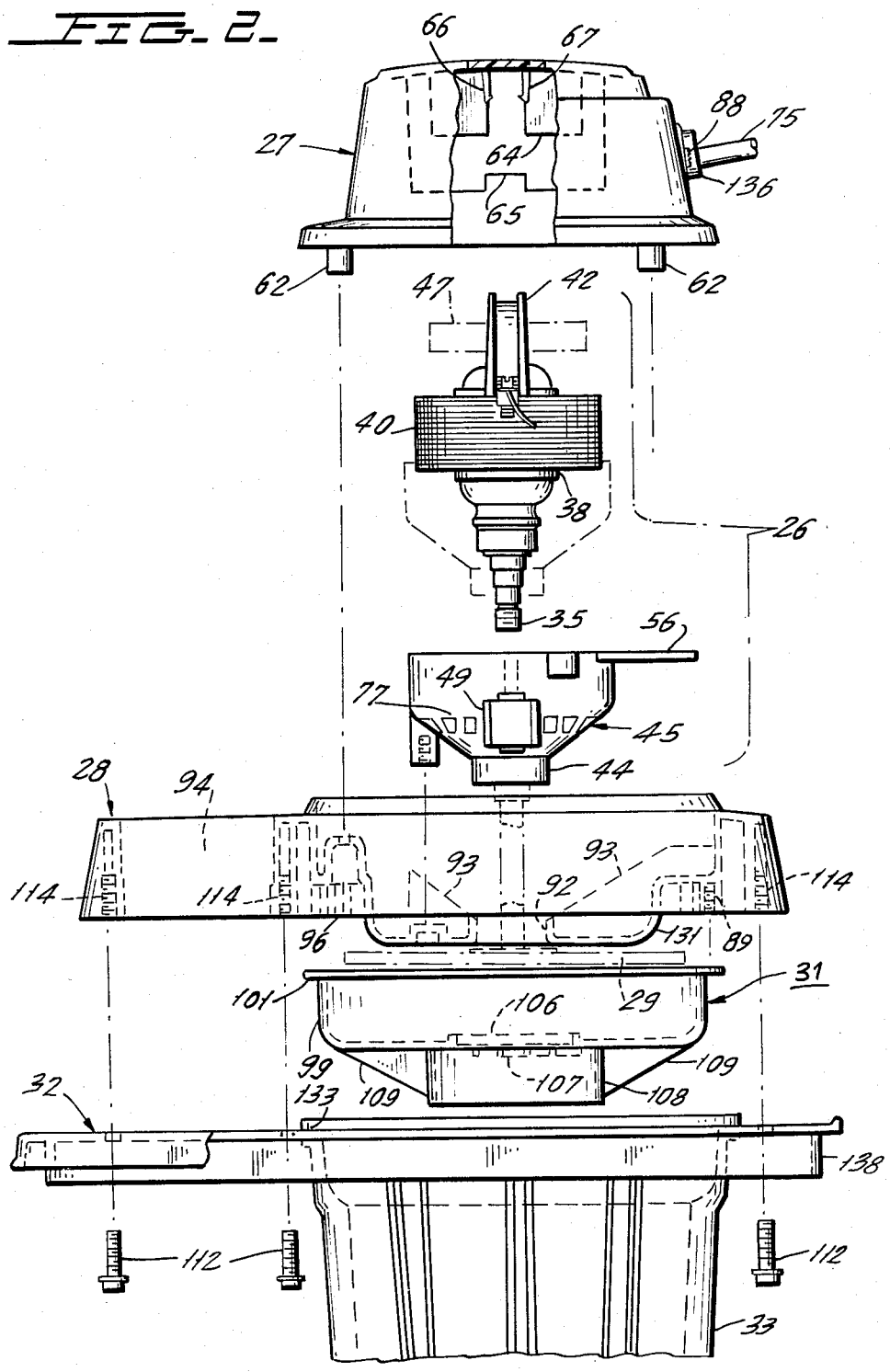
FIG. 2 is a side elevation showing major elements of FIG. 1 separated from one another.

Now referring to the drawings in which FIG. 1 illustrates the upper portion of so-called bypass type vacuum cleaner 20 including vertically upright tank 21, circular in horizontal cross-section, having lid assembly 25 removably secured to its upper end by a plurality of pivoted latches 24. Inlet fitting 22 for the attachment of a vacuum hose is secured to tank 21 at a side opening near the top thereof.

The main elements of assembly 25 are electric motor 26, inverted cup-like motor cover 27, blower housing 28, pancake type fan impeller 29, fan cover 31 and tank lid 32 having float cage 33 depending therefrom and formed integrally therewith. The upper end of motor 26 is disposed within cover 27 and the lower end of motor 26 is disposed within depression 34 in the upper surface of blower housing 28. Impeller 29 is secured to the lower end of motor shaft 35 and is disposed within chamber 36 formed between formations of housing 28 and cover 31. In a conventional manner, ball type float 37 is disposed within cage 33 and positioned below cover 31.

Figure 3:
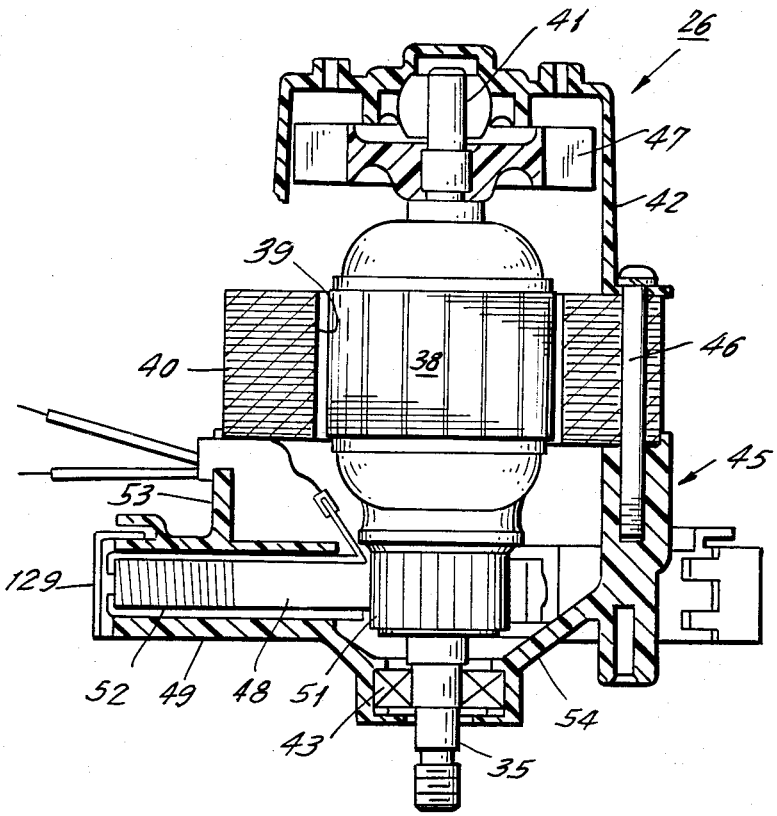
FIG. 3 is a vertical cross-section of the electric motor.
Figure 4:
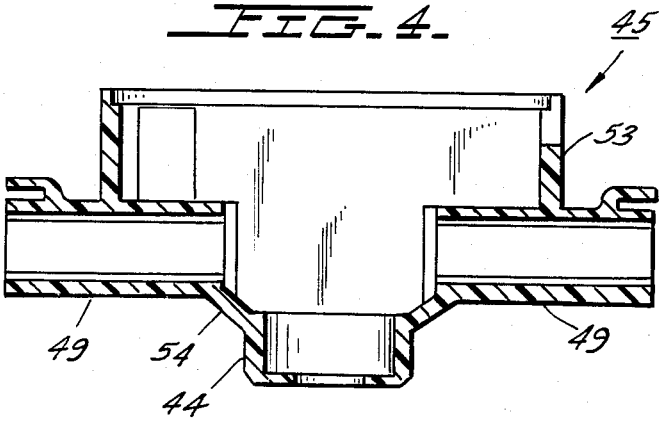
FIG. 4 is a cross-section of the lower housing for the electric motor taken through lines 4—4 of FIG. 5 looking in the direction of arrows 4—4.

As seen best in FIG. 3, in addition to vertically positioned shaft 35, motor 26 includes wound rotor 38 mounted to shaft 35 and disposed within central opening 39 in pole piece means 40. Upper bearing 41 for shaft 35 is secured to the web portion of inverted U-shaped metal bracket 42 and lower bearing 43 for shaft 35 is disposed within annular extension 44 at the lower end of molded insulated lower housing 45. Screws 46 extend through outwardly turned feet of bracket 42 and through clearance apertures in pole piece 40, and are threadably received in apertures of lower housing 45 to securely sandwich pole means 40 in operative position between bracket 42 and lower housing 45. Cooling fan blade 47 is mounted to the upper end of motor shaft 35 and rotates between the spaced arms of bracket 42. Rotor 38 is electrically energized through a pair of carbon brushes 48 disposed within radially extending housings 49, 49 formed integrally with housing 45. The radially inner end of each brush 48 bears against commutator 51 mounted on shaft 35 and the outer end of each brush 48 is engaged by coiled compression spring 52. The latter retained within housing 49 by clip 129 and biases brush 48 inward. The upper portion 53 of housing 45 is generally cylindrical and is connected to annular extension 44 by perforated conical section 54. For a reason which will hereinafter be explained, housing 45 is provided with cover portion 56 that is generally flat and outwardly extending, being at the upper end of cylindrical section 53 and apertures 57 receive screws 46. Lower housing 45 is also provided with aperture 58 which threadably receives screws 55 (FIG. 1) that secure blower housing 28 directly to motor 26.

As seen in FIGS. 9 and 10, motor cover 27 is an inverted cup-shaped member including sloping annular side wall 59 that extends downward from downwardly horizontal top wall 61. Extending downward from side wall 59 are three lugs 62 that threadably receive individual screw 63 (FIG. 1) which secure blower housing 28 directly to motor cover 27. Extending downward from upper wall 61 are generally annular inner and outer partitions 64, 65, the latter extending more downward than the former for a reason which will hereinafter be seen. Also extending downward from top wall 61 and formed integrally therewith are two pairs of snap type hook ended clips 66, 67 which secure cover 27 to motor 26 by engaging the web portion of bracket 42. Partition 64 is provided with diametrically opposite slots which provide clearance for insertion of motor bracket 42. Adjacent to each slot in the partition 64 cover 27 is provided with internal formations 68 that cooperate with bracket 42 to locate motor 26 relative to cover 27. Two generally parallel side walls, 69, 69 which partially define junction box 71 extend between outer partition 65 and side wall 59. The portion of side wall 59 that partially defines junction box 71 is provided with aperture 72 for switch 73 (FIG. 8) and aperture 74 for strain relief 136 that surrounds line cord 75.

Figure 8:
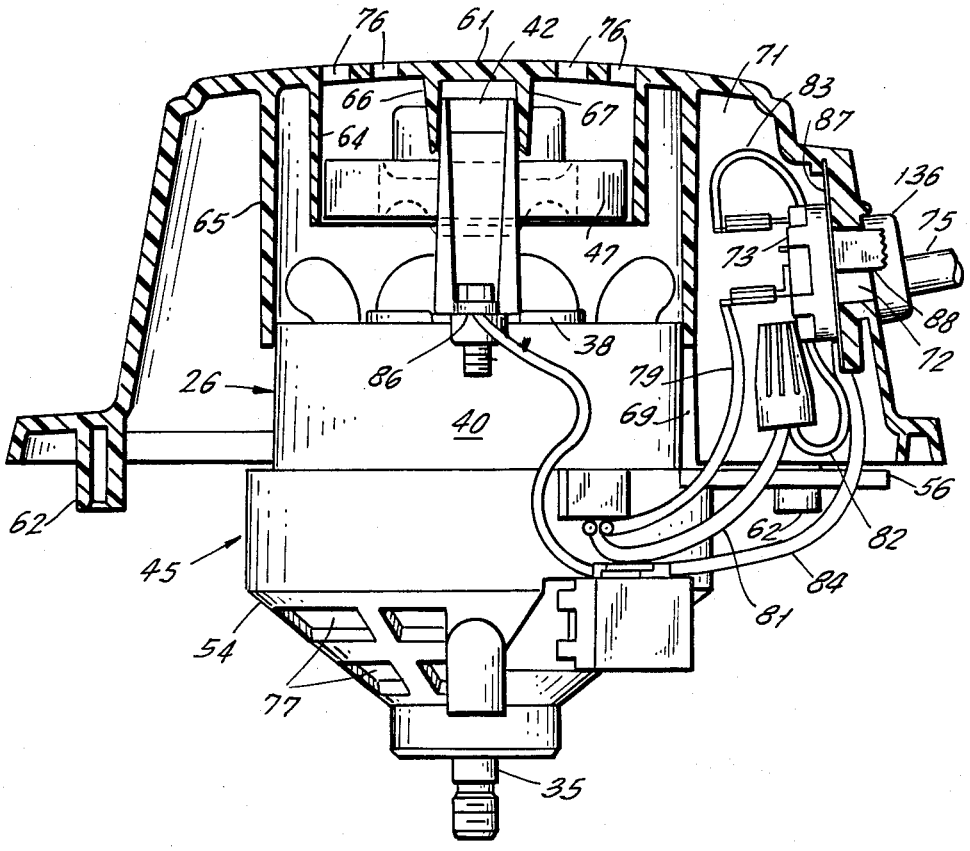
FIG. 8 is a vertical cross-section of the motor cover with the motor and other elements assembled thereto.
Figure 11:
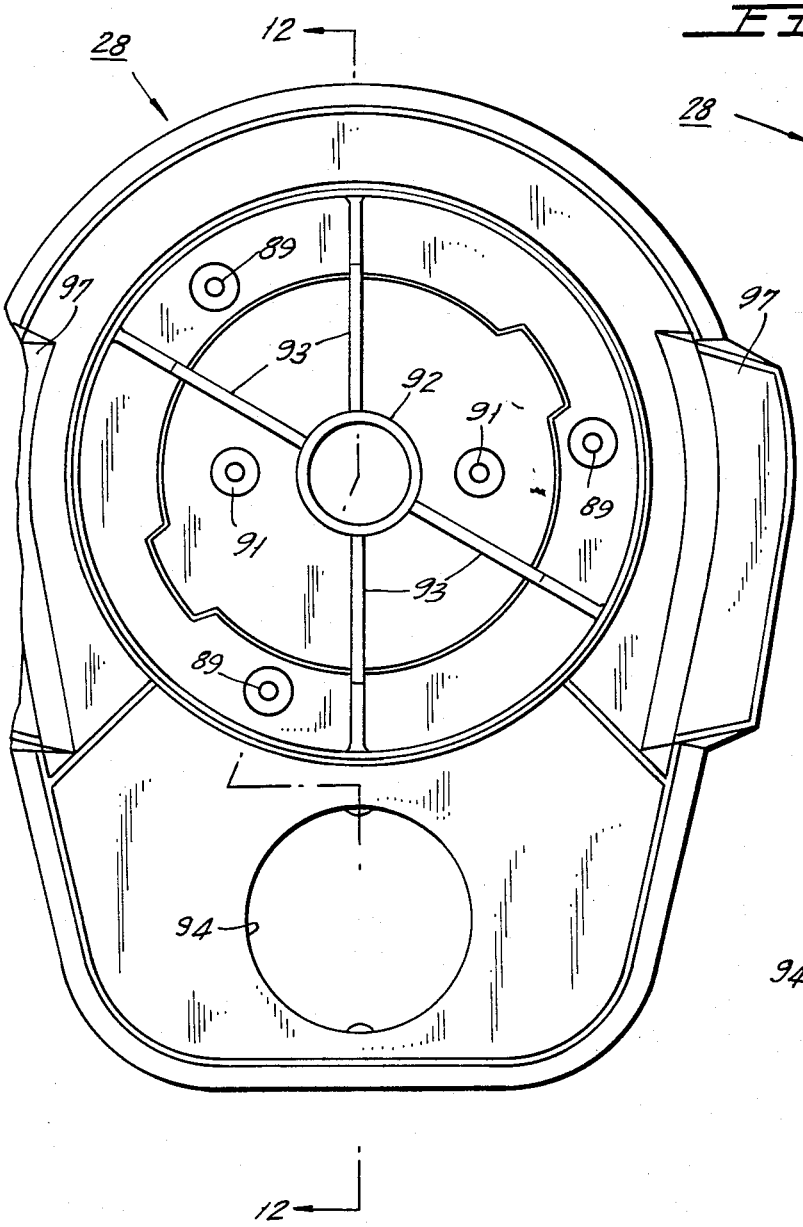
FIG. 11 is a plan view of the blower housing.
Figure 12:
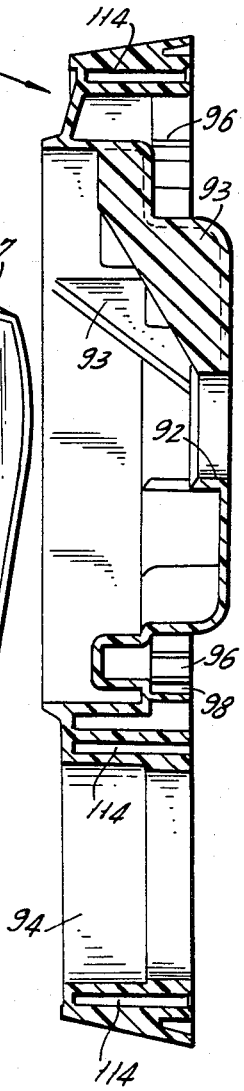
FIG. 12 is a cross-section taken through line 12—12 of FIG. 11 looking in the direction of arrows 12—12.
Figure 13:
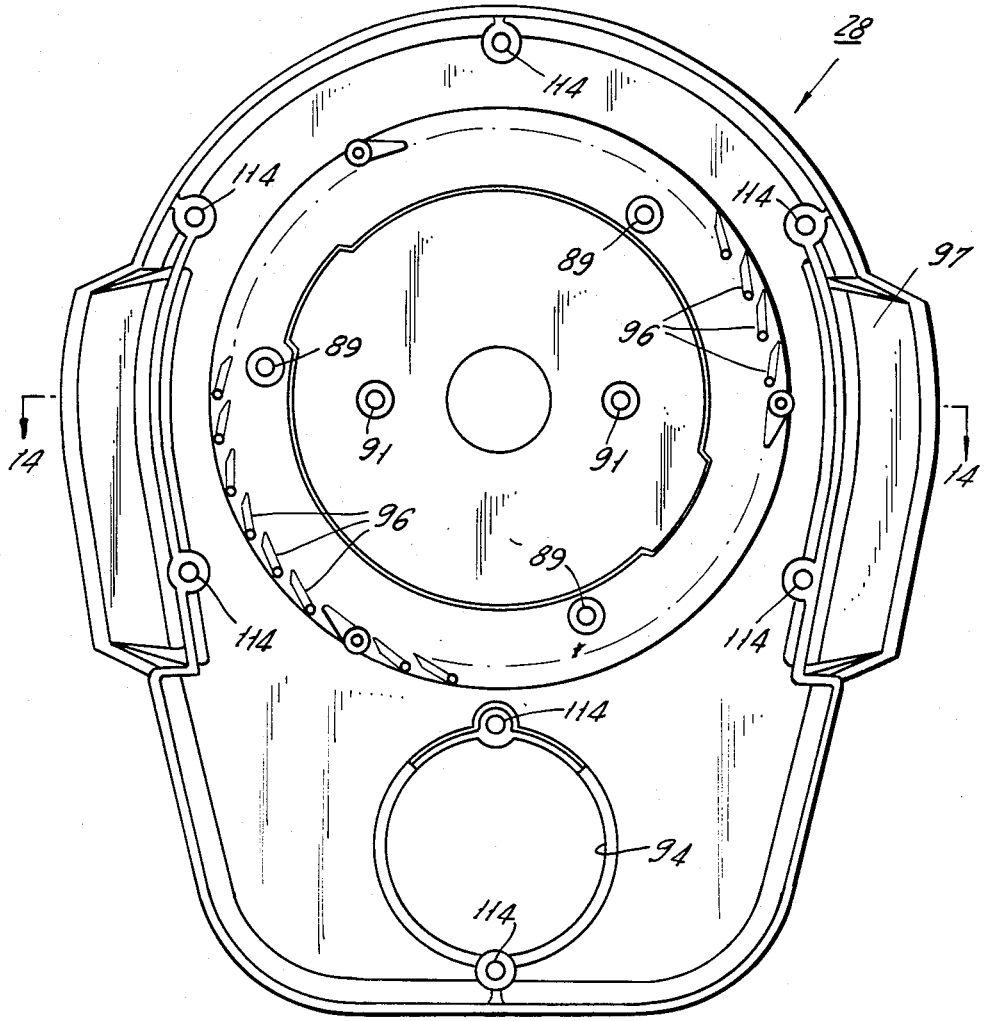
FIG. 13 is a bottom view of the blower housing.
Figure 14:
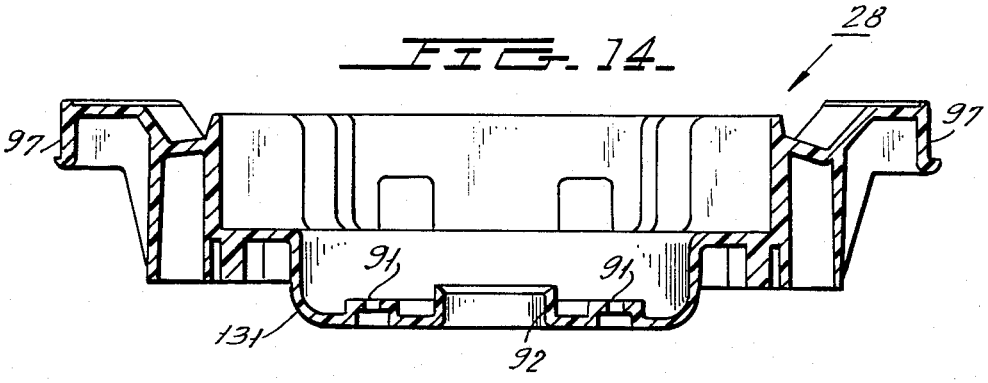
FIG. 14 is a cross-section taken through line 14—14 of FIG. 13 looking in the direction of arrows 14—14.

As seen in FIG. 8, when motor 26 and cover 27 are assembled, inner partition 64 is closely fitted around the periphery of auxiliary fan blade 47 and outer partition 65 partially overlaps pole piece 40. Where this overlapping occurs there is a relatively close fit between partition 65 and pole piece 40. This assures that rotation of fan blade 47 will draw motor cooling air into cover 27 through apertures 76 in top wall 61, which apertures 76 are disposed inboard of inner wall 64. This air will be forced downward through motor 26 and will be exhausted therefrom through apertures 77 in the conical portion 54 of blower housing 45, and then will be exhausted from cover 27 through apertures 78 thereof. Outer partition 65 prevents the exhaust air from attempting to exit through apertures 76.

Within junction box 71, motor lead 79 is connected to one terminal switch 73, motor lead 81 is connected to lead 82 from line cord 75, and lead 83 of line cord 75 is connected to the other terminal of switch 73. Ground lead 84 of line cord 75 is connected to motor bracket 42 at terminal 86. As seen in FIG. 8, extension 56 of lower housing 45 serves to close the lower end of junction box 71. The perforations in extension 56 provide clearance apertures for leads 79, 81 and 84 to extend out of the bottom of junction box 71. Spring clip 87 mechanically secures switch 73 in operative position with its manually operable slide control 88 projecting through aperture 72 to the outside of cover 27. Both covers 27 and 45 are molded of plastic material that is fire resistant so that if the remaining portion of vacuum 20 is destroyed by fire, the electrical connections within junction box 71 will not be exposed.

Blower housing 28 illustrated in detail in FIGS. 11–14 is a member molded of plastic material and includes three clearance apertures 89 for screws 63 that secure housing 28 to cover 27, and two clearance apertures 91 for screws 55 that mechanically secure housing 28 directly to blower cover 45 in motor 26. In addition, housing 28 is provided with depressed portion 131 having centrally located short upwardly extending sleeve 92 that is closely fitted around the outside of downward extension 44 of blower motor cover 45 to form a watertight seal. Inclined upper edge surfaces of webs 93 engage the conical portion 54 of blower motor housing 45 to fix the position of motor 26 at its lower end.

Laterally offset from depressed portion 131, housing 28 is provided with exhaust port 94 which communicates with expansion plenum 95 that receives the main stream of air produced by rotation of impeller 29 after such air passes through vanes 96 that are formed integrally with blower housing 28 at the bottom thereof and along the outer side surface of depressed portion 131. Vanes 96 are disposed in a circular array above and slightly outboard of the periphery of impeller 29. Handles 97 formed integrally with blower housing 28 along opposite sides thereof are provided to facilitate handling of assembly 25 when it is removed from tank 21.

Figure 16:
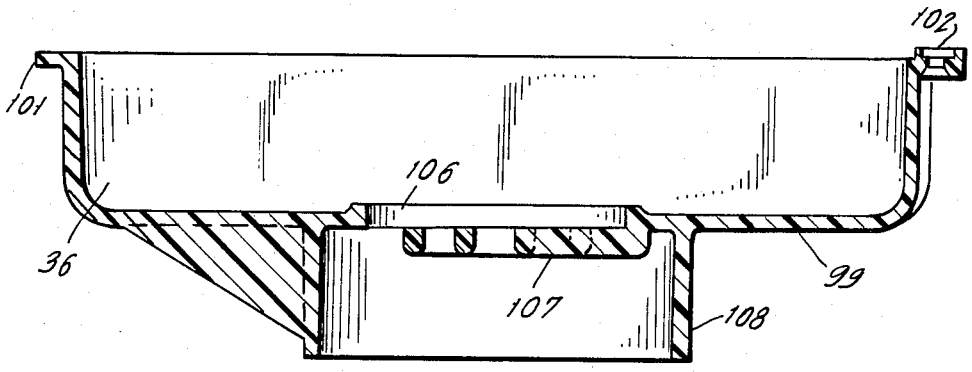
FIG. 16 is a cross-section taken through line 16—16 of FIG. 15 looking in the direction of arrows 16—16.
Figure 15:
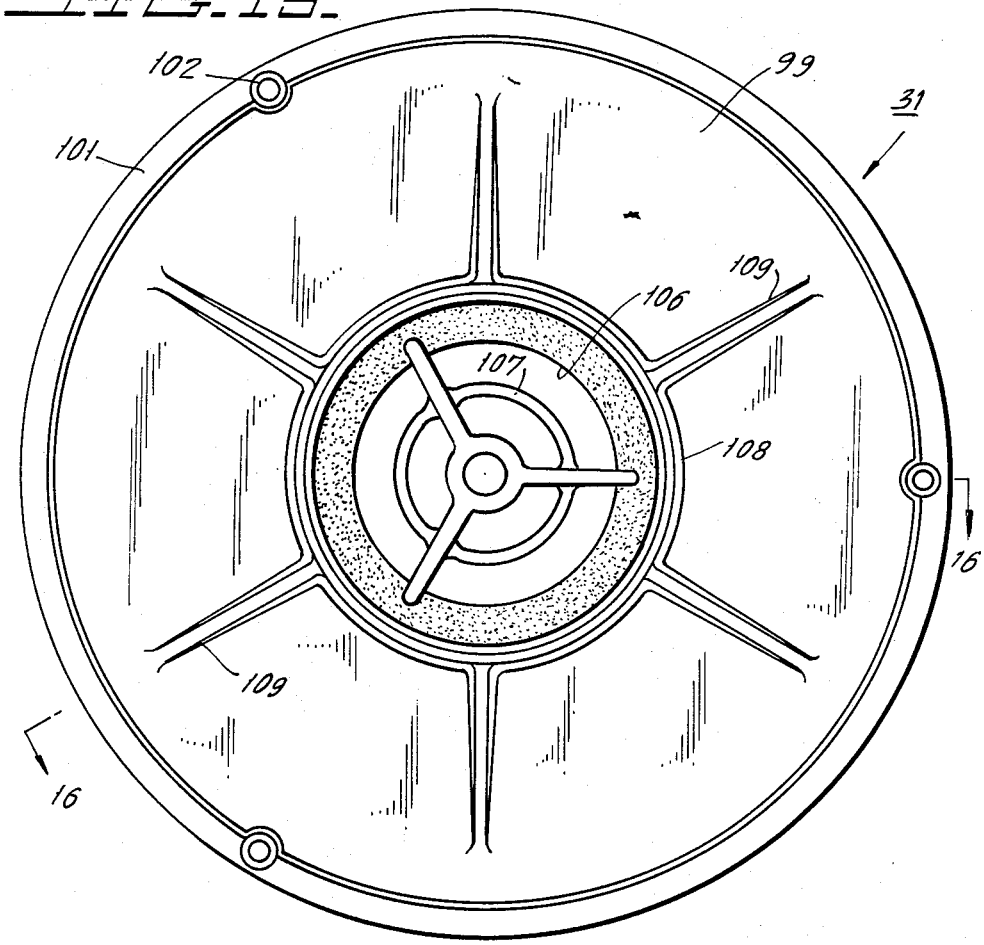
FIG. 15 is a plan view of the fan cover.

Fan cover 31 of FIGS. 15 and 16 is in the form of a shallow disk 99 that provides chamber 36 wherein impeller 29 is disposed. Outwardly extending lip 101 at the upper end of dish 99 is provided with three clearance apertures 102 through which screws 103 (FIG. 1) extend to be threadably received by apertures 104 to mechanically secure fan cover 31 directly to blower housing 28. Air intake aperture 106 is disposed at the center of dish 99 and is covered by grillwork 107 that is constructed to moderate noise produced by air being drawn inward by impeller 29. Surrounding intake aperture 106 and extending downward from dish 99 is annular flange 108 which is of the diameter and length that will permit ball 37 to be floated into sealing engagement therewith. Ribs 109 extend radially outward from flange 108 to rigidify cover 31.

Annular flange 133 extending upward from lid 32 closely surrounds lip 101 of fan cover 31 while downwardly extending annular flange 138 of lid 32 lies adjacent the inner side surface of tank 21. Seven screws 112 extend through clearance apertures in lid 32 and are threadably received in bores 114 of blower housing 28 to mechanically secure the latter to lid 32. Lip 101 is also sandwiched between lid 32 and portions of blower housing 28 so that cover 31 cannot be removed while lid 32 is secured to housing 28.

The elements previously described are inverted and then assembled in the following manner.

1. The electrical connections are made between line cord 75 and switch 73 and motor 26, after which clip 87 secures switch 73 in its operative position and line cord 75 is withdrawn until an appropriate length thereof remains in junction box 71 after which strain relief 136 is snapped into aperture 74.
2. The upper end of motor 26 is then fully inserted into motor cover 27 and is held in this position by snap acting clips 66, 67.
3. Screws 63 are inserted to secure blower housing 28 to motor cover 27 and screws 55 mechanically secure blower housing 28 to blower motor housing 45.
4. Impeller 29 is mounted to shaft 35 utilizing nuts 117 and spacers 118, 119.
5. Screws 103 mechanically secure fan cover 31 to lower housing 28.
6. Float ball 37 is placed on flange 108.
7. Screws 112 secure lid 32 to blower housing 28 to complete assembly 25.

Thus, it is seen that the major components of assembly 25 are mechanically secured to one another without the necessity of inverting or otherwise moving any of these elements once they are mechanically secured in position.

It should now be understood by those skilled in the art that within the scope of the instant invention the embodiment hereinbefore described may be modified in many ways. For example, a dome or cap (not shown) may be placed over motor cover 27 to prevent rain from entering through apertures 76, 78, with such dome having internal partitions to direct cooling air being exhausted from apertures 78 away from intake apertures 76; blower housing 28 may be configured to provide a spiral plenum downstream of vanes 96 in place of open plenum 95; fan cover 31 may be relatively flat in which event depressed portion 131 of blower housing 28 will be made shallower, flat or domed, and motor cover 27 will be taller; and/or both the inlet and outlet for main vacuum air flow may be at the top of the blower housing.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. A removable lid assembly for a by-pass type vacuum cleaner; said assembly including: a concave motor cover; an electric motor having an upper portion and a lower portion, said upper portion being disposed within said motor cover, said motor further having a vertical output shaft; a blower housing having the lower portion of said motor disposed therein with a portion of said shaft extending below said blower housing; a suction producing fan impeller secured to said portion of said shaft; a fan cover disposed below said blower housing and cooperating therewith to define an impeller chamber in which said impeller rotates, said fan cover having an intake opening defined therein; flow regulating vanes in said impeller chamber; a removable tank lid for supporting the motor cover, the motor, the blower housing and the fan cover, said blower housing and said tank lid at least partially defining an expansion chamber radially outward of said impeller chamber; said impeller when rotating drawing suction producing air upward through said intake opening in said fan cover and directing said air radially outward past said flow regulating vanes into said expansion chamber; said motor being sandwiched between said motor cover and said blower housing; first fastening means for securing said blower housing to said motor cover, said first fastening means being inserted at the bottom side of said blower housing; second fastening means for securing said fan cover to said blower housing, said second fastening means being inserted at the bottom side of said fan cover; third fastening means for securing said lid to said cover, said third fastening means being inserted at the bottom side of said lid.

2. An assembly as in claim 1 in which said lid is operatively positioned to block separation of said fan cover from said blower housing until after said lid is removed from said blower housing.

3. An assembly as in claim 1 in which said motor cover on the inside thereof is provided with clip means that secures said motor to said motor cover before the latter is secured to said blower housing.

4. An assembly as in claim 3 in which said motor cover and said blower housing are each constructed of plastic insulating material, said clip means being integral with said motor cover and being of a snap-engaging type.

5. An assembly as in claim 1 also including a cooling fan mounted to the upper end of said shaft, said motor cover having an internal downwardly extending inner partition surrounding said cooling fan, and intake aperture means disposed inboard of said partition.

6. An assembly as in claim 5 in which the motor includes a pole piece through which said shaft extends, said motor cover having an internal downwardly extending outer partition surrounding said inner partition and extending therebelow to lie adjacent said pole piece and direct cooling air out of said motor cover through exhaust aperture means disposed outboard of said outer partition.

7. An assembly as in claim 1 in which the motor also includes a lower housing having an annular extension through which said shaft extends, said blower housing having an annular sleeve formation surrounding said annular extension and being closely fitted therewith to provide a seal against liquid flowing upward into said motor cover.

8. An assembly as in claim 7 in which the motor includes a lower bearing for said shaft, said lower bearing being retained in said annular extension.

9. An assembly as in claim 1 in which the flow regulating vanes are integral with the blower housing.

10. An assembly as in claim 1 in which the blower housing is provided with an outlet opening for said suction producing air, said outlet communicating with said expansion chamber and disposed downstream thereof.

11. An assembly as in claim 1 also including an electrical junction box within said motor cover, a motor control switch within said box having an operating handle extending outside of said motor cover, a plurality of electrical connections disposed within said junction box, said connections joining said motor and said switch in an energizing circuit for said motor.

12. An assembly as in claim 11 in which said motor cover further includes internal partitions for defining the major portion of said junction box, said internal partitions extending below said grid means, said motor further comprising a lower housing integrally including a box cover for closing said junction box at its bottom.

13. An assembly as in claim 12 in which both the motor cover and the lower housing are constructed of fire resistant plastic insulating material.

14. An assembly as in claim 1 in which said fan cover includes grid means disposed at said intake opening in said fan cover to moderate noise generated by flow of suction producing air, said fan cover also including an annular flange surrounding said intake opening in said fan cover and extending below said grid means.

15. A removable lid assembly for a by-pass type vacuum cleaner; said assembly including: a concave motor cover; an electric motor having an upper portion and a lower portion, said upper portion being disposed within said motor cover, said motor further having a vertical output shaft; a blower housing having the lower portion of said motor disposed therein with a portion of said shaft extending below said blower housing; a suction producing fan impeller secured to said portion of said shaft; a fan cover disposed below said blower housing and cooperating therewith to define a chamber in which said impeller rotates, said fan cover having an intake opening defined therein; said impeller when rotating drawing suction producing air upward through said intake opening in said fan cover and directing said air radially outward; a removable tank lid for supporting the motor cover, the motor, the blower housing and the fan cover, said motor being sandwiched between said motor cover and said blower housing; first fastening means for securing said blower housing to said motor cover, said first fastening means being inserted at the bottom side of said blower housing; second fastening means for securing said fan cover to said blower housing, said second fastening means being inserted at the bottom side of said fan cover; third fastening means for securing said lid to said cover, said third fastening means being inserted at the bottom side of said lid.

* * * * *

UNITED STATES PATENT AND TRADEMARK OFFICE

CERTIFICATE OF CORRECTION

PATENT NO. : 4,538,971

DATED : September 3, 1985

INVENTOR(S) : Jonathan Miller et al.

It is certified that error appears in the above-identified patent and that said Letters Patent is hereby corrected as shown below:

Column 4, lines 29 and 33 - delete "cover" and substitute therefor --housing-- lines 3, 29, 33 and 35 - delete "blower" and substitute therefor --lower--

Column 5, line 20 - delete second occurrence of "blower" and substitute therefor --lower-- line 25 - delete "lower" and substitute therefor --blower--

Column 6, line 19 - delete "cover" and substitute therefor --blower housing--

Column 8, line 21 - delete "cover" and substitute therefor --blower housing--

Signed and Sealed this

Twenty-sixth Day of April, 1988

*Attest:*

DONALD J. QUIGG

*Attesting Officer*

*Commissioner of Patents and Trademarks*